United States Patent [19]

Knapp

[11] 4,077,079

[45] Mar. 7, 1978

[54] PIPELINE PIG

[76] Inventor: Mary M. Knapp, 1209 Hardy St., Houston, Tex. 77020

[21] Appl. No.: 716,029

[22] Filed: Aug. 19, 1976

[51] Int. Cl.[2] ..... B08B 9/04

[52] U.S. Cl. ..... 15/104.06 R

[58] Field of Search ..... 15/3.5, 3.51, 104.06 R, 15/104.06 A; 134/8

[56] References Cited

U.S. PATENT DOCUMENTS

| | | | |
|---|---|---|---|
| 3,011,197 | 12/1961 | Nehse et al. | 15/104.06 R |
| 3,277,508 | 10/1966 | Knapp | 15/104.06 R |
| 3,389,417 | 6/1968 | Knapp et al. | 15/104.06 R |

*Primary Examiner*—Leonard D. Christian
*Attorney, Agent, or Firm*—Donald Gunn

[57] ABSTRACT

A new and improved pig is disclosed. In the preferred embodiment, the pig is constructed of a foamed plastic body which is elongate, shaped somewhat like a bullet and which body is wrapped with spiraled cloth which is joined into the bullet shaped body by the elastomeric material which forms the body. The cloth material is a backing for metal staples which are U-shaped and which position pairs of parallel points extending outwardly. They form collectively an abrasive surface on the body which enables it to clean a pipeline. An improvement is incorporated wherein an additional coat of elastomeric material encapsulates the staples, supporting them in a fixed relative position to one another and which additional coating material is on the exterior of the belting to support the staples.

4 Claims, 2 Drawing Figures

FIG. 1
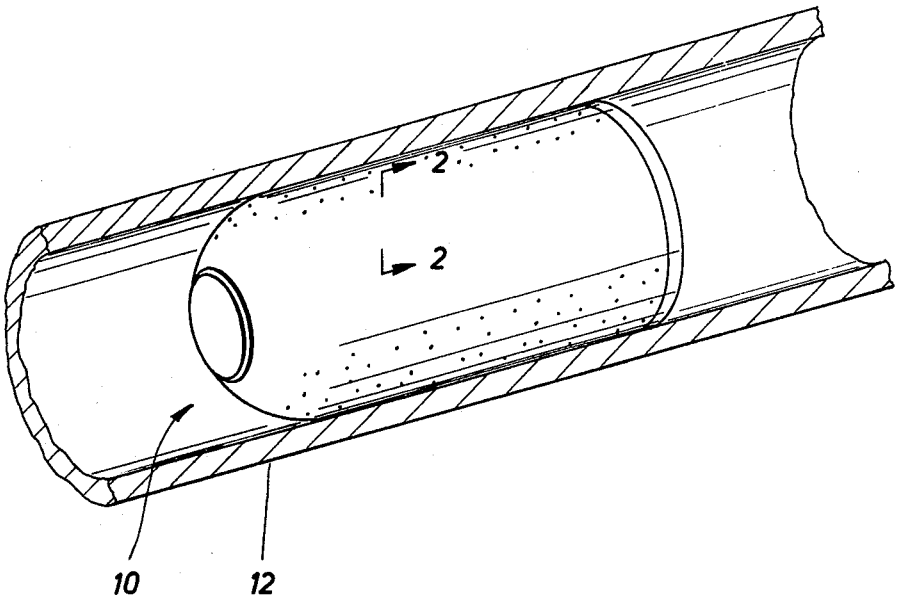
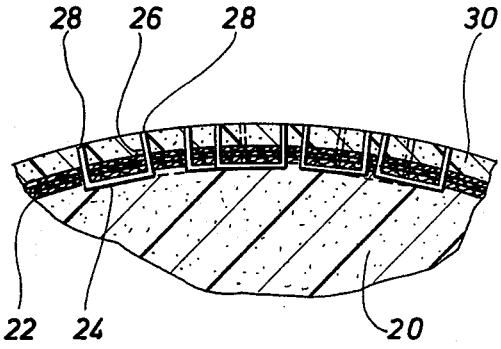
FIG. 2

PIPELINE PIG

BACKGROUND OF THE INVENTION

Pipeline pigs utilizing staples in a cloth backing have been used heretofore. The cloth with staples is a material available from the textile industry, and it is often referred to as carding cloth. It is formed of multiple layers of a backing cloth such as heavy ducking or the like. A number of U-shaped staples are driven through the cloth backing to position a set of points which points are so close together as to define an abrasive surface on the exterior of the pig. It has been discovered that the staple legs and points on the staple legs tend to chatter as the pig passes through a pipeline.

The points themselves bear against the wall of the pipe and thereby clean the pipe which is the intended purpose of the pig. However, the certain problems have arisen in the use of pipeline cleaning pigs of this sort. It appears now in retrospect that the cantilevered staple legs have tips which abrade the surface of the pipe but in so doing, they tend to chatter and set up oscilliations or even shock waves in the staples which cause rapid metal fatigue or wear. The metal fatigue might occur at any point in the U-shaped staple while the accelerated wear occurs from the tip or point of the staple. Accordingly, the life of the staples has been limited and of course when they collectively fatigue or fail, the pig must be taken out of service.

The present disclosure overcomes this problem. Heretofore, pigs have been constructed where the cloth backing of the carding cloth has been bonded into the elastomeric body of the pig. The staples have been left free so that the cantilevered tips have been unsupported. The present invention overcomes this infirmity. The present invention contemplates forming a pipeline pig wherein an external coating is placed on the pig which coating engulfs the cantilevered tips or points of the staples. This provides surrounding support and positional stability to the metal staples. This holds them in a relatively fixed position and thereby cuts down on chatter as they abrade against the surface of the pipe. In addition, the exterior coating surface is able to support some of the weight of the pig thereby reducing the point loading on the staples and thereby increasing the life of the pig. It is not necessary to make the pig heavy to achieve heavy loading on the tips of the staples because they are so small in cross sectional area at the point of contact that the loading is quite high, even with a very lightweight pig body. So to speak, it is not necessary that the points abrade so deeply into the film or accumulation of coatings in the pipes that the pipe is clean to bare metal; rather, a cleaning away of the accumulation of materials deposited by the flow in the pipe itself as exemplified by water scale is adequate.

SUMMARY OF THE DISCLOSURE

This disclosure is directed to a new and improved pipeline pig. This pig is new and it is characterized in that it has an elongate foam body which is surrounded by spiraled strips of carding cloth which support a set of protruding staples. The staples are so grouped that they define an abrading surface on the exterior formed by the tips of the staples. The improvement comprises the placement of a supplemental coating on the exterior of the pig which coating extends to the surface defined by the tips of the staples. This coating is preferably formed of a heavier elastomeric mix. It is coated over the staples and surrounds them thereby limiting oscillatory or chattering movement and further reducing the point loading on each tip so as to extend the life of the pig.

DESCRIPTION OF THE DRAWINGS

FIG. 1 shows the improved pig of the present invention in a pipeline; and

FIG. 2 is a sectional view through the skin of the pig showing a set of U-shaped staples supported by a cloth backing of multiple layers and discloses a supplemental elastomeric coating placed on the exterior of the pig.

DESCRIPTION OF THE PREFERRED EMBODIMENT

In the drawings, the improved pig of the present invention is indicated by the numeral 10 and is shown in a pipe 12 for cleaning the interior surface. It is adapted to be used in situations to clean pipes as might occur in the build up of scale in water pipes. The apparatus is particularly adapted to clean the pipe 12 by scraping away accumulations on the inside surface. It is forced through the pipe 12 by the pressure gradient acting against the pig. The pressure gradient forces the pig through the pipe. As it travels, it cleans the pipe and will clean the pipe for the full length of the pipeline as it moves in the pipe.

The pig of the present invention is formed of an elongate body formed of foamed plastic material, typically a polyurethane. The plastic material which comprises the major portion of the body is bullet shaped. It is formed of foam typically in the range of about 2 pounds per cubic foot and up typically to the maximum of no more than about 30 pounds per cubic foot. If a stiffer and more firm body is desired, a lightweight core can be used with a thin hard coating on the exterior made of polyurethane to define a composite body. The outer layer thus is formed of a harder polyurethane coating typically with a hardness measuring up to 50 or 90 Shore A durometer Rockwell hardness.

The present applicant has heretofore devised a pipeline pig in which carding cloth, which is cloth having a set of staples, is placed on the pig in spirals to define a pig for scraping a pipeline. The present disclosure is directed to an improvement in that apparatus. The carding cloth has heretofore been attached to the pig by positioning the carding cloth in the mold at the time of the manufacture of the pig. The foamed plastic material used in the fabrication of the pig body is poured into the mold and intimately contacts and embeds the cloth backing of the carding cloth to thereby anchor the carding cloth to the pig body. The cloth supports so many U-shaped staples that they define an abrasive surface. Each staple is formed of a U-shaped member which has a pair of legs each terminating in a tip or point. The staples are driven through the cloth backing. The cloth backing typically is formed of two to five layers of cloth depending on the application of the material. While the number of layers of cloth is not critical, they are nevertheless helpful to hold the staples in a specified relative position with respect to one another so that they extend radially outwardly from the pig. The staples are so close together that the carding cloth defines an abrasive surface formed of the many metal staple tips considered in the aggregate. This yields a pig which has been very successful.

This present improvement comprises a supplemental layer of coating material of an increased density which is coated on the pig body after the carding cloth has been embedded at its cloth backing into the body of the pig. This enables the carding cloth to be first anchored and held in position. The supplemental coating placed on it then surrounds the individual staple legs. FIG. 2 illustrates this in better detail. There, the pig body is indicated by the numeral 20. The numeral 22 identifies multiple layers of cloth, typically heavy ducking cloth, which are layered to support and hold a set of staples 24 in a specified relative location. The staples pass through multiple layers of cloth so they will be held erect. The many staples pass through multiple layers and thus they are fairly well fixed in relative position. This prevents individual staples from laying over.

Many staples are shown in FIG. 2 but it is adequate to describe the present invention with regard to a single staple and extend the description to all the staples and then the entire pig body. The carding cloth is embedded as previously stated to the body 20. Multiple staples are carried in the carding cloth. The staple 24 includes a leg 26. The leg 26 terminates at a point 28. Each staple includes two legs. Each leg terminates in the point 28 shown in FIG. 2. It extends radially outwardly of the pig body even without the coating of elastomeric material which is placed on the exterior in accordance with the teachings of this disclosure.

After the cloth backing is affixed to the body and after the body has been made to size and shape, it is subsequently dipped in a liquid elastomeric material such as polyurethane. A coating is formed on the body having a hardness in the range of 50 to 90 Shore A durometer on the Rockwell scale. This is a fairly hard but fairly thin coating and is therefore somewhat flexible. Its thickness approximates that required to extend to the tip of the staples. Greater thicknesses are not required.

As will be observed in FIG. 2, the additional coating identified by the numeral 30 has a thickness which extends to the plane defined by the tips 28 of the multitude of staples. This need not be measured precisely and indeed some regional variations may occur but, in the main, the thickness of the coating 30 is sufficient to cover over the backing cloth 22 and extend to the level defined by the staple tips.

The incorporation of the elastomeric coating 30 thus sets out the improvement of the present invention which provides several benefits in operation. As will be observed, the leg 26 of the staple is held fixedly in position. It is not cantilevered and hence, it does not tend to chatter or vibrate as the tip 28 abrades the metal surface of the pipe. Different modes of vibration can occur dependent on loading, gauge of the wire, length of the staple, and many other factors. The vibrations or chatter imparted to the staple contribute to the wear of the staple. Wear occurs as it is abraded against the pipe. Eventually, the staple wears down to the cloth backing. The rate of wear is dependent on the manner in which the staple vibrates. It appears as a theory of operation of the improved pig disclosed herein that the elastomeric coating holds the staple legs against vibration and thereby enables it to last a good deal longer. It thus provides steady scratching contact against the surface of the pipe rather than chattering. Chattering apparently heretofore involved contact and then a long skip in contact followed by subsequent chattering contact again. In other words, the tip of the staple, without the improvement of the present invention, did heretofore contact the pipe too firmly or not at all as it chattered. With the improvement of the present invention, the contact is made more uniform. There is therefore a decreased tendency to chatter. This theory is advanced as an aid in the understanding of the device and is not a limitation on its operation.

The elastomeric coating 30 appears to serve as additional purpose. It is therefore offered as a second theory of operation. A correct appraisal of the events is the belief that the elastomeric coating 30 carries some of the weight of the pig and reduces the weight actually imparted to the staple tip 28. The supplemental coating 30 thus provides its own scraping action. In addition, the load on the staple is reduced. Becaue the load is reduced, it has longer life. Even with reduced axial loading on the staple 28, it still has sufficient contact with the pipeline to clean the pipe.

With regard to the loading or weight on the staple, the pig is operated in one of two ways. In one manner, the pig is slightly undersized for the pipe and accordingly, the staples which are located underneath the pig carry the weight of the pig in the pipe. In the event the pig fits snuggly in the pipe as might occur when it is slightly oversized, the weight of the pig is carried by the staples on the bottom but in addition to that, radial loading on the pig fully around its circumference may occur as a result of the circumferential compression of the pig to force it into the pipe. In either case, the radial force component acting on the pig body itself which is imparted by each individual staple leg 26 is reduced. So to speak, the incorporation of the coating 30 reduces the point loading but it does not reduce it in a manner to interfere with the cleaning action customarily contemplated for the apparatus.

As will be seen from this description, the pig of the present invention utilizes the carding cloth in a much different manner than heretofore established in the pipeline pig art. The theories of operation which were discussed heretofore were disclosed solely as a theory and were not intended to limit or otherwise constrain the scope of the present disclosure which is protected by the claims appended hereto. Variations in the structure within the scope of the claims are incorporated thereby.

I claim:

1. An improved pipeline pig which comprises:

an elongate body having an outer surface thereon which is adapted to pass through a pipeline;

a cloth backing embedded in the surface of said body having a plurality of U-shaped staples extending radially outwardly of the pig; and a supplemental elastomeric coating on said pig body which coating surrounds the legs of the U-shaped staples and which coating is applied to a thickness bringing its outer surface to a depth approximately equal to the length of the staple legs extending from the pig.

2. The apparatus of claim 1 wherein said coating has a hardness of about 50 to 90 Shore A durometer hardness on the Rockwell scale.

3. The apparatus of claim 1 wherein said coating is applied to the staple legs to fixedly support them and hold them in place.

4. The apparatus of claim 3 wherein said coating is sufficiently thick to support at least some but not all of the weight of the pig when in a pipe line.

* * * * *